US006200110B1

(12) United States Patent
Chou

(10) Patent No.: US 6,200,110 B1
(45) Date of Patent: Mar. 13, 2001

(54) AIR COMPRESSOR

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 0 days.

(21) Appl. No.: 09/259,789

(22) Filed: Mar. 1, 1999

(51) Int. Cl.[7] ..... F04B 17/03

(52) U.S. Cl. ..... 417/415; 92/59; 92/118; 92/169.1; 417/550

(58) Field of Search ..... 92/59, 60.5, 118, 92/140, 169.1; 417/415, 550; 137/543.17, 540

(56) References Cited

U.S. PATENT DOCUMENTS 1,055,437 * 3/1913 Aldridge ..... 137/543.17
3,961,868 * 6/1976 Droege, Sr. et al. ..... 417/550
5,655,887 * 8/1997 Chou ..... 417/63

* cited by examiner

*Primary Examiner*—Edward K. Look
*Assistant Examiner*—Thomas E. Lazo
(74) *Attorney, Agent, or Firm*—Charles E. Baxley

(57) ABSTRACT

An air compressor includes a housing having a tube extended from the top and having a passage communicating the housing with the tube and having a tapered surface. A piston is slidably received in the chamber of the housing and is forced to move along the housing in a reciprocating action and to force the air out through the tube via the passage. The provision of the tapered surface allows the piston to smoothly move in the housing. A stop is adjustably spring-biased to block the passage. The piston has a spring blade to block an aperture to control the air into the housing.

6 Claims, 5 Drawing Sheets

AIR COMPRESSOR

BACKGROUND OF THE INVENTION

1. Field of the Invention

The present invention relates to a compressor, and more particularly to an air compressor.

2. Description of the Prior Art

Typical air compressors comprise a piston slidably received in a housing, and a motor coupled to the piston for moving the piston along the housing in a reciprocating action. However, the outlet air may not be adjusted.

The present invention has arisen to mitigate and/or obviate the afore-described disadvantages of the conventional air compressors.

SUMMARY OF THE INVENTION

The primary objective of the present invention is to provide an air compressor in which the outlet air may be adjusted to the required condition.

The other objective of the present invention is to provide an air compressor in which the piston housing may be adjusted to different positions.

In accordance with one aspect of the invention, there is provided an air compressor comprising a housing including a tube extended therefrom and including a passage formed therein and communicating the housing with the tube, the housing including a chamber formed therein and including a tapered surface formed therein and close to the tube, a piston slidably received in the chamber of the housing, and means for forcing the piston to move along the chamber of the housing in a reciprocating action and to force air in the chamber of the housing out through the tube via the passage. The tapered surface is provided for allowing the piston to smoothly move along the chamber of the housing.

The tube includes a stop slidably received therein, and means for forcing the stop to resiliently block the passage. The forcing means includes a spring engaged with the stop, and means for adjusting a resilience force of the spring against the stop.

The piston includes an aperture formed therein for allowing the air to flow into the housing from an outside of the housing, and means for resiliently blocking the aperture of the piston. The aperture blocking means includes a spring blade having a first end secured to the piston and having a second end for blocking the aperture of the piston, the air is allowed to flow into the housing via the aperture when the piston is moved away from the tube.

A base is further provided, a pin is eccentrically secured to the base, the piston includes a rod extended therefrom and secured to the pin, and means for rotating the pin to move the piston along the chamber of the housing in the reciprocating action. The piston forcing means includes a motor secured to the base and having a pinion, a gear is rotatably secured to the base at a pivot shaft and engaged with the pinion of the motor, the pin is extended from the gear and eccentric relative to the pivot shaft.

The housing may be adjusted away from or toward the pin for adjusting the piston relative to the tube and for adjusting the air compressed by the piston when the piston is moved along the chamber of the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
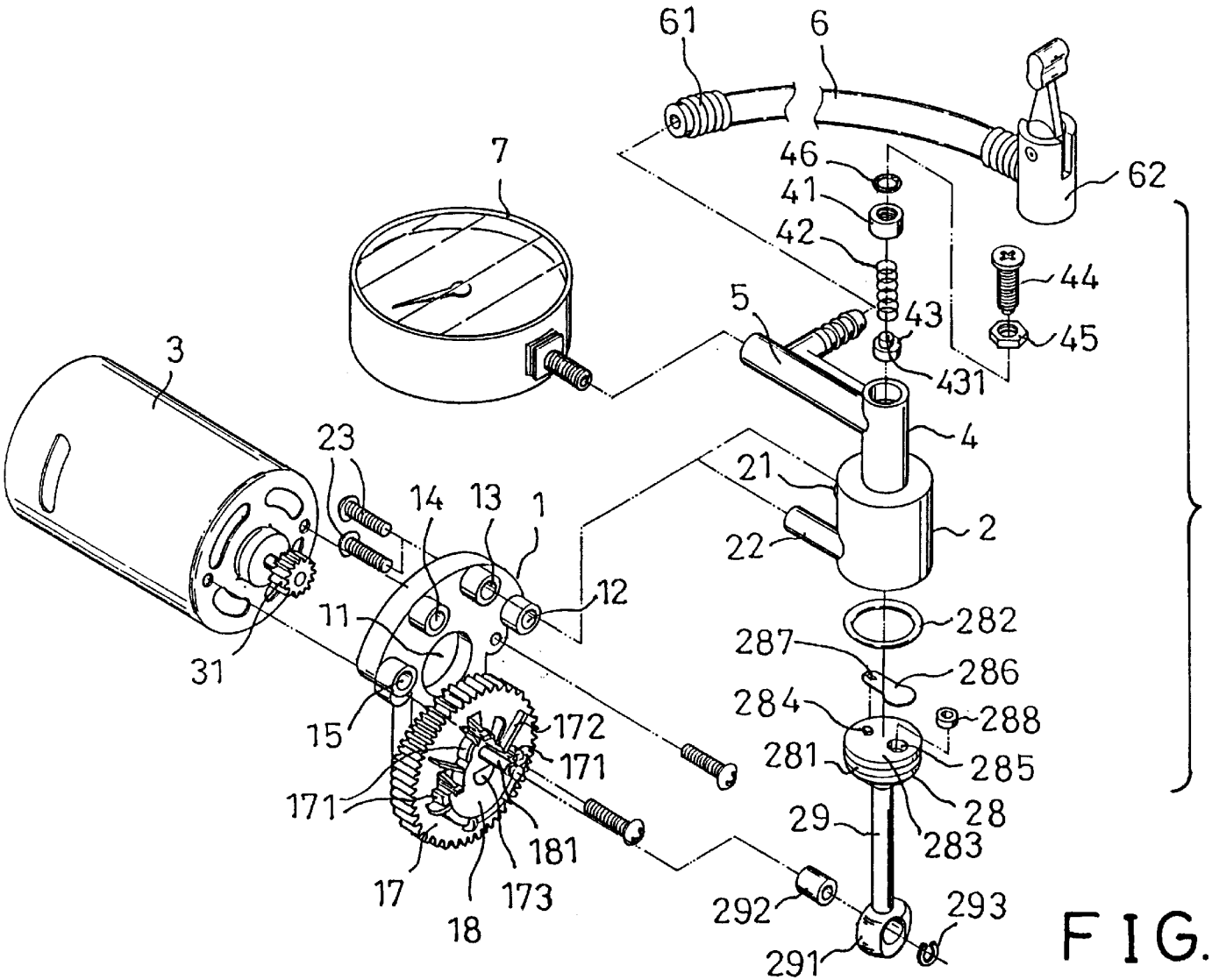
FIG. 1 is an exploded view of an air compressor in accordance with the present invention.
Figure 2:
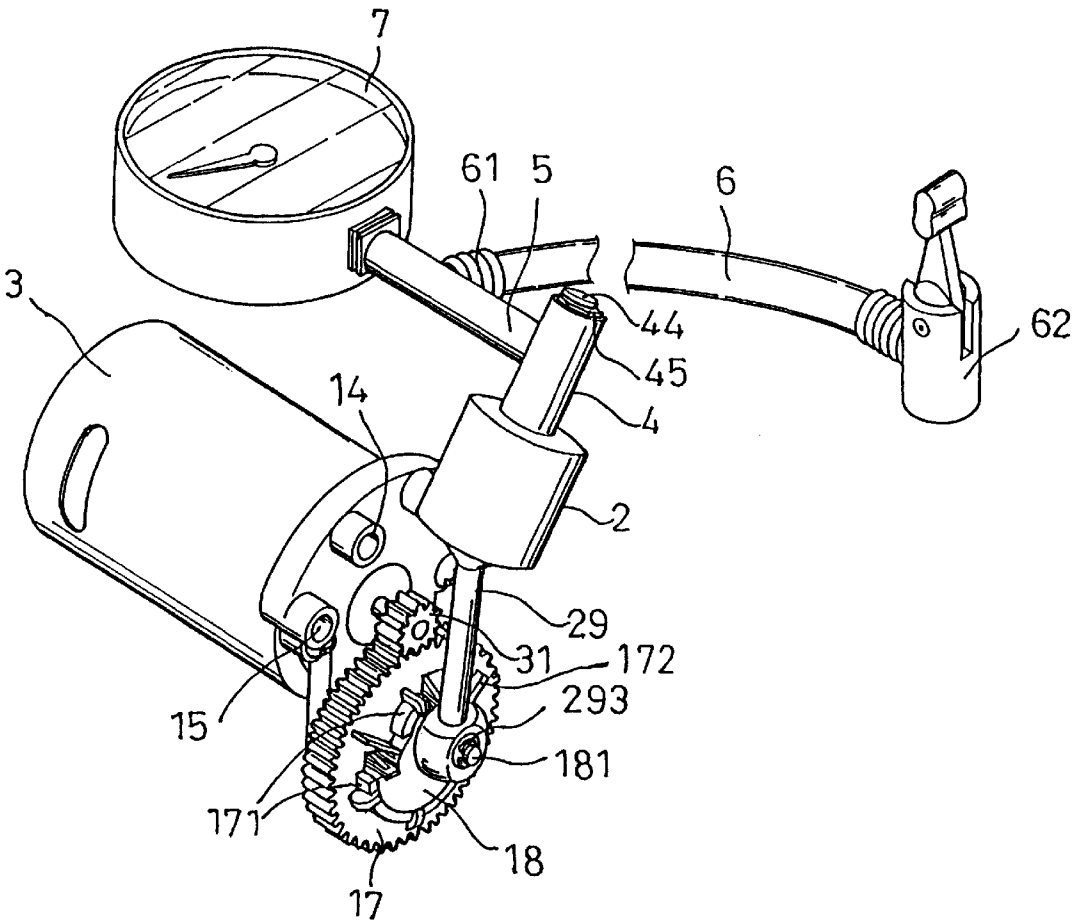
FIG. 2 is a perspective view of the compressor.
Figure 3:
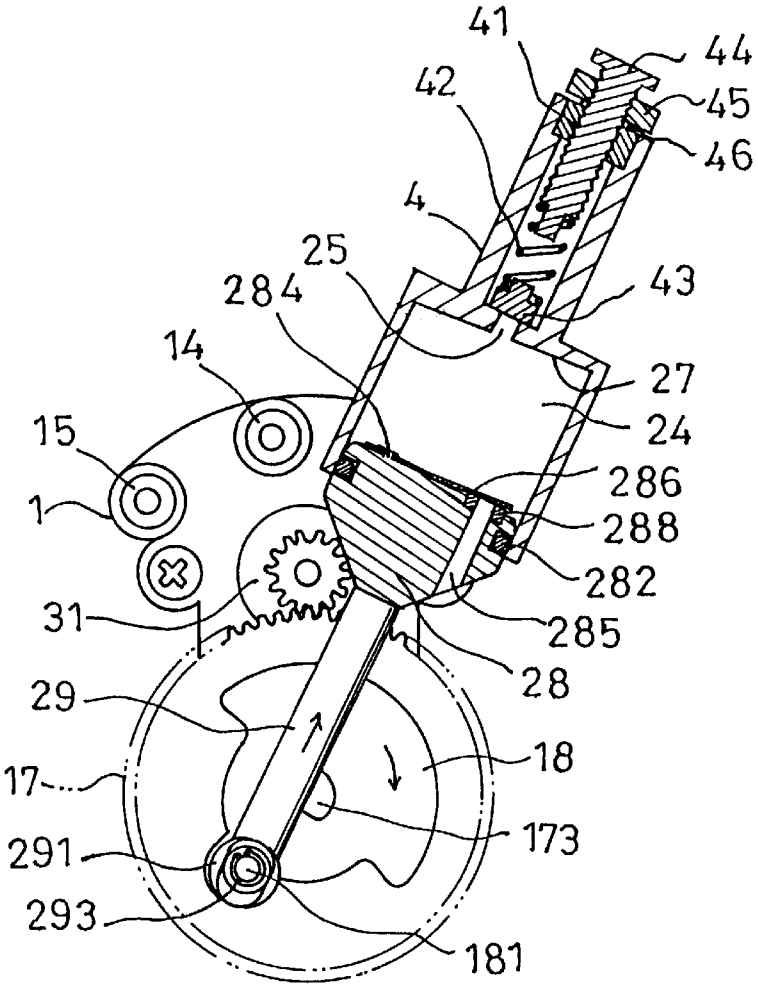

Referring to the drawings, and initially to FIGS. 1–3, an air compressor in accordance with the present invention comprises a base 1 including an opening 11 for receiving a pinion 31 of a motor 3 which is secured to the base 1 by fasteners. The base 1 includes four hubs 12, 13, 14, 15 formed therein and includes a gear 17 and a block 18 rotatably secured to the base 1 at a pivot shaft 173. The gear 17 includes a number of protrusions 171 extended therefrom for supporting the block 18 in place and includes a number of fins 172 for heat dissipation purposes. The block 18 includes a pin 181 extended therefrom and spaced from the pivot shaft 173 such that the pin 181 is eccentric relative to the pivot shaft 173. The pin 181 may also be directly extended from the gear 17, instead of from the block 18.

Figure 9:
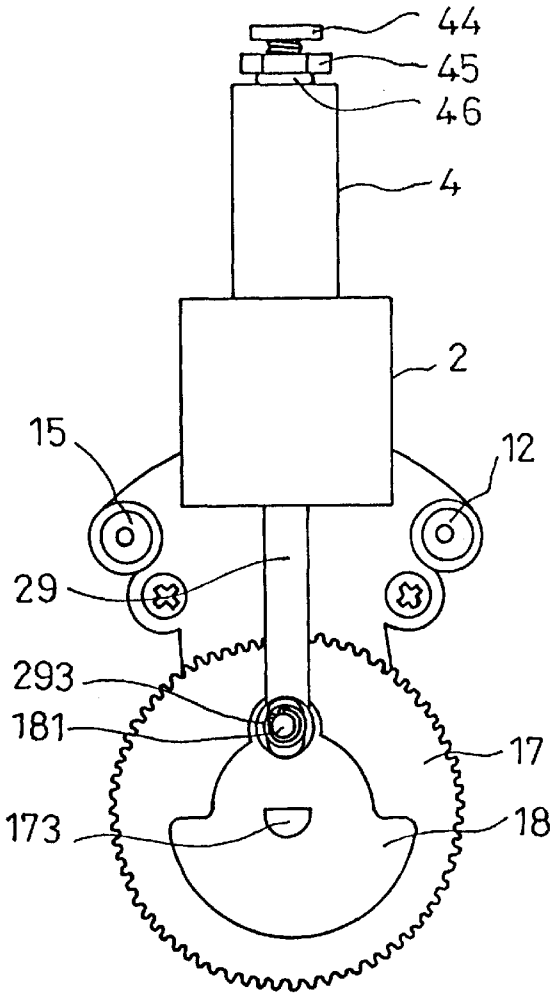
FIGS. 7, 8, 9 are plane views illustrating the applications of the air compressor.
Figure 8:
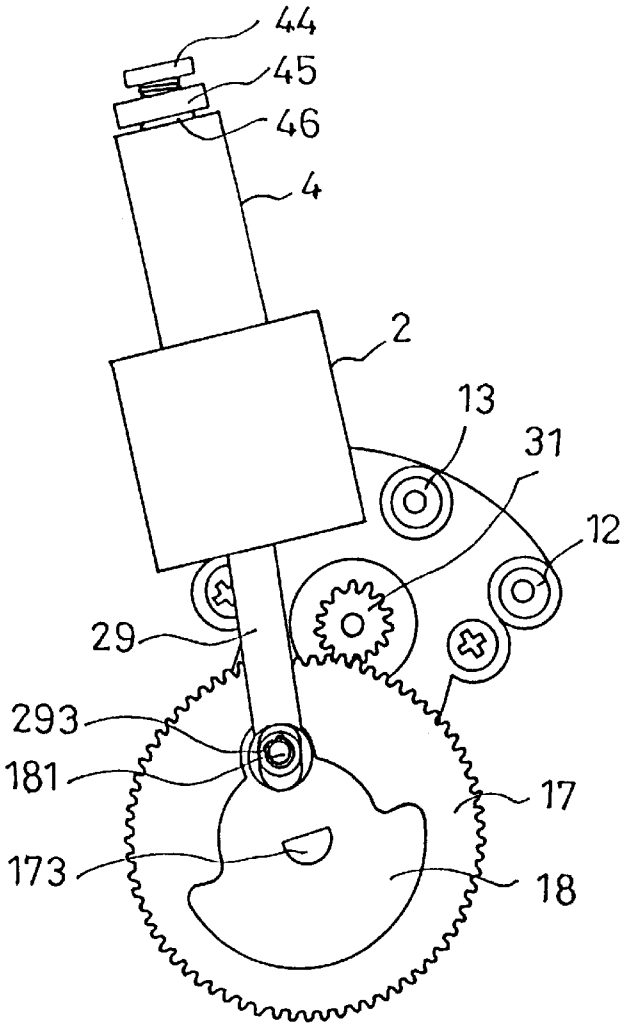
Figure 7:
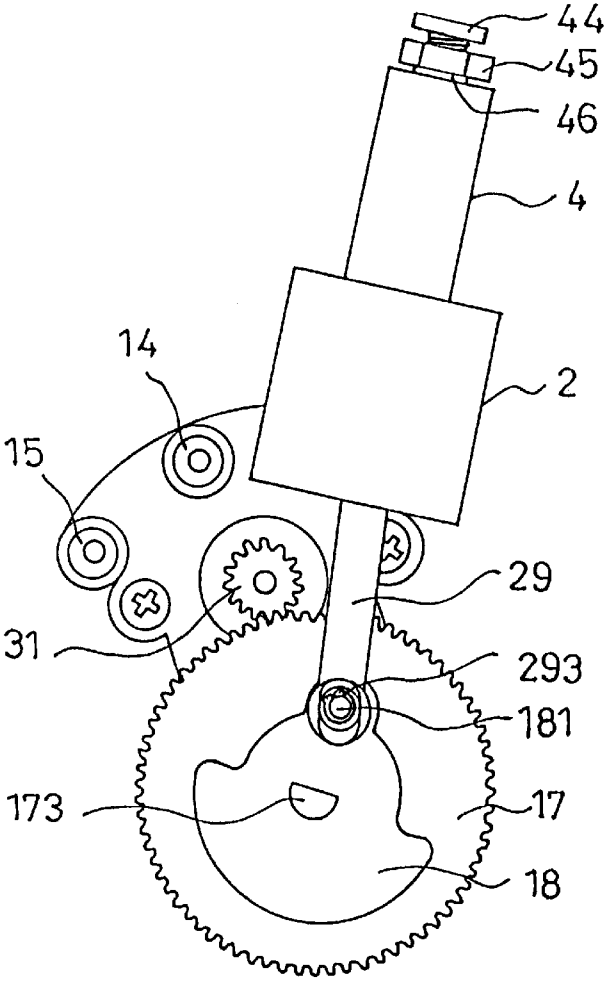

A housing 2 includes two projections 21, 22 secured to either two adjacent hubs of the hubs 12, 13; or 13, 14; or 14, 15 by fasteners 23. The hub 15 has a greatest distance away from the pivot shaft 173 than that of the hub 14 which has a distance further away from the pivot shaft 173 than the hub 13. The hub 12 is closer to the pivot shaft 173 than the hub 13; such that the housing 2 may be slightly adjusted away from or close to the pivot shaft 173 by securing to different hubs 12, 13 (FIG. 7); or 13, 14 (FIG. 9); or 14, 15 (FIG. 8). The housing 2 includes a tube 4 extended upward therefrom, and includes a pipe 5 extended from the tube 4 and coupled to a nozzle 62 via a coupler 61 of a hose 6. The housing 2 includes a passage 25 communicating the housing 2 with the tube 4. A stop 43 is slidably received in the tube 4 for blocking the passage 25 and includes a bulge 431 (FIG. 1) for engaging with a spring 42. A gasket 41 is secured in top of the tube 4 and a bolt 44 is threaded with the gasket 41, a lock nut 45 is engaged with the bolt 44 for locking the bolt 44 to the tube 4. A sealing ring 46 is engaged between the gasket 41 and the nut 45 for making an air tight seal therebetween. The bolt 44 is engaged with the spring 42 for adjusting the spring force of the spring 42 against the stop 43. An air gage 7 is coupled to the pipe 5 for measuring the air pressure in the housing 2.

As best shown in FIG. 3, the housing 2 includes a tapered surface 27 formed therein and located closed to the tube 4 and includes a chamber 24 formed therein for slidably receiving a piston 28 therein. The piston 28 includes an annular groove 281 formed in the outer peripheral portion thereof for receiving a sealing ring 282 which may make an air tight seal between the piston 28 and the housing 2. The piston 28 includes a rod 29 extended downward therefrom and having a ring 291 rotatably secured to the pin 181 by a bearing 292 and secured in place by a clamping ring 293, such that the piston 28 may be moved along the housing 2 in a reciprocating action by the eccentric pin 181 of the gear 17 by the motor 3. The piston 28 includes an upper surface 283 having a swelling 284 extended therefrom for engaging into a hole 287 of a spring blade 286, and includes an aperture 285 formed therein for allowing the air to flow from outside of the housing 2 into the chamber 24 of the housing 2. A gasket 288 is engaged in the aperture 285 for engaging with the spring blade 286 which may engage with the gasket 288 to block the aperture 285 of the piston 28 (FIGS. 3, 5, 6).

Figure 4:
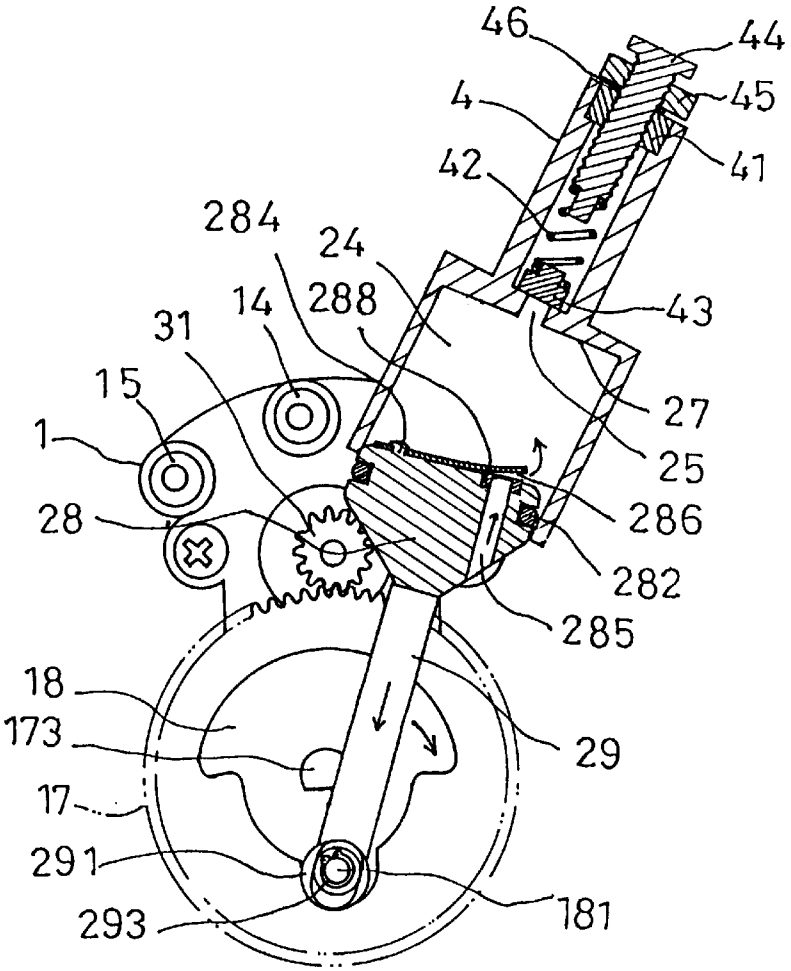
FIGS. 3, 4, 5, 6 are partial cross sectional views illustrating the operation of the air compressor.
Figure 6:
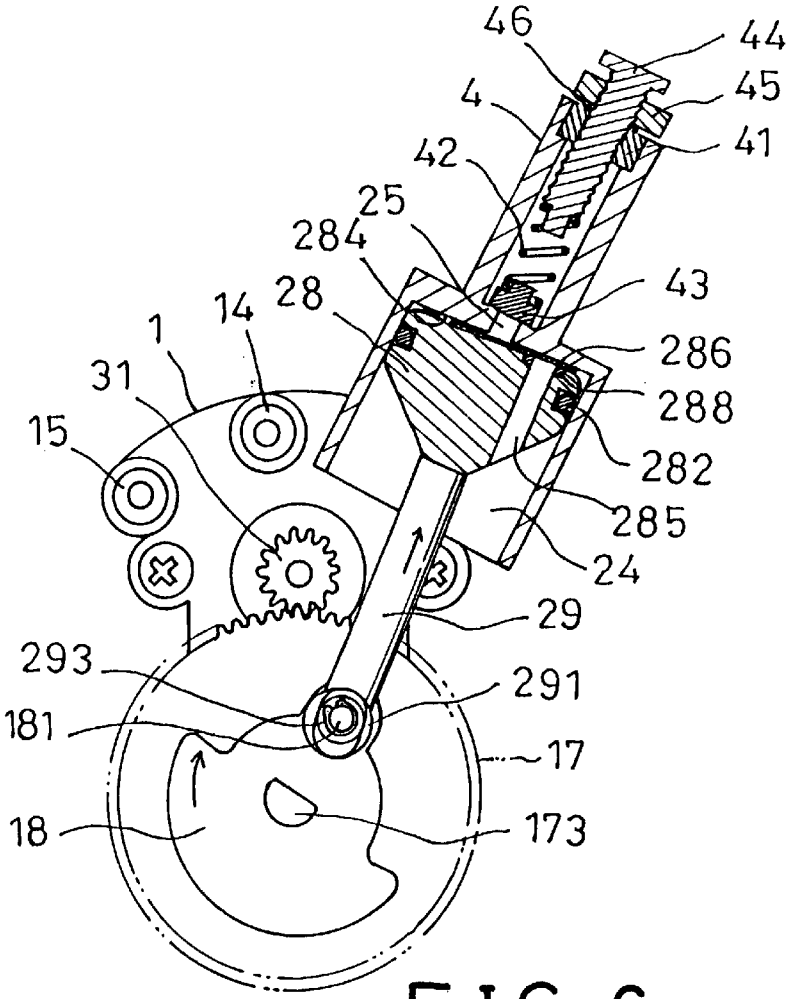
Figure 5:
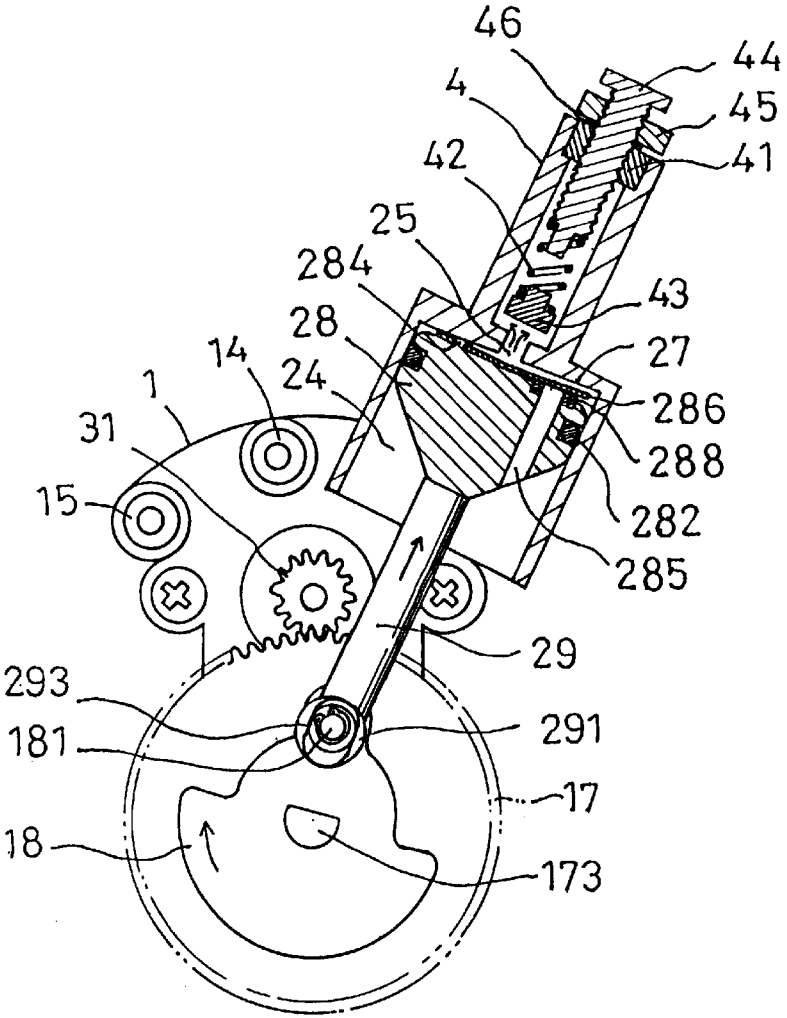

In operation, as shown in FIGS. 3–6, the piston 28 may be moved up and down along the housing 2 in a reciprocating action by the motor 3 via the eccentric pin 181 of the block 18 of the gear 17. When the piston 28 is moved toward the tube 4, the spring blade 286 may block the aperture 285 of the piston 28 and may force the air in the chamber 24 of the housing 2 out of the tube 4 through the passage 25 and to force against the stop 43 (FIG. 5). The provision of the tapered surface 27 of the housing 2 and the engagement of the piston 28 with the tapered surface 27 of the housing 2 allow the eccentric pin 181 and the piston 28 and the rod 29 to smoothly pass through the top dead point of the pin 181 (FIGS. 5, 6). When the piston 28 moves downward from the top position as shown in FIG. 6, the passage 25 will be blocked by the stop 43, and the air may be drawn into the chamber 24 of the housing 2 via the aperture 285 against the spring blade 286, as shown in FIG. 4. The air may then be forced through the tube 4 again when the piston 28 is forced toward the tube 4 again. The air may thus be effectively forced through the tube 4.

Referring again to FIGS. 7–9, when the housing 2 is adjusted and secured to different hubs 12, 13; or 13, 14; or 14, 15, the piston 28 may be adjusted away from the tube 4 for a small distance, such that the chamber 24 of the housing 2 may be slightly increased.

As shown in FIGS. 3–6, the adjustment of the spring 42 by the bolt 44 may be used to adjust the air pressure of the air that may be forced out through the stop 43 against the spring 42. When the resilience of the spring 42 has been changed, the bolt 44 may be adjusted to force the spring 42 to adjust the resilience of the spring 42 back to the normal or the required resilience.

Accordingly, the air compressor in accordance with the present invention includes a structure for allowing the outlet air to be adjusted to the required condition. In addition, the piston housing may be adjusted to different positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a housing including a tube extended therefrom and including a passage formed therein and communicating said housing with said tube, said housing including a chamber formed therein and including a tapered surface formed therein and close to said tube, a piston slidably received in said chamber of said housing, means for forcing said piston to move along said chamber of said housing in a reciprocating action and to force air in said chamber of said housing out through said tube via said passage, said tapered surface being provided for allowing said piston to smoothly move along said chamber of said housing, a base, a pin eccentrically secured to said base, said piston including a rod extended therefrom and secured to said pin, means for rotating said pin to move said piston along said chamber of said housing in the reciprocating action, and means for adjusting said housing away from said pin.

2. The air compressor according to claim 1, wherein said tube includes a stop slidably received therein, and means for forcing said stop to resiliently block said passage.

3. The air compressor according to claim 2, wherein said forcing means includes a spring engaged with said stop, and means for adjusting a resilience force of said spring against said stop.

4. The air compressor according to claim 1, wherein said piston includes an aperture formed therein for allowing the air to flow into said housing from an outside of said housing, and means for resiliently blocking said aperture of said piston.

5. The air compressor according to claim 4, wherein said aperture blocking means includes a spring blade having a first end secured to said piston and having a second end for blocking said aperture of said piston, the air is allowed to flow into said housing via said aperture when said piston is moved away from said tube.

6. The air compressor according to claim 1, wherein said piston forcing means includes a motor secured to said base and having a pinion, a gear is rotatably secured to said base at a pivot shaft and engaged with said pinion of said motor, said pin is extended from said gear and eccentric relative to said pivot shaft.

* * * * *